US005077847A

United States Patent [19]

Boyd

[11] Patent Number: 5,077,847

[45] Date of Patent: Jan. 7, 1992

[54] WATERBED MATTRESS CORNER AND METHOD OF MAKING SAME

[76] Inventor: Dennis Boyd, 14457 Rouge River, Chesterfield, Mo. 63017

[21] Appl. No.: 490,390

[22] Filed: Mar. 8, 1990

[51] Int. Cl.[5] ..... A47C 27/08; A47C 31/00

[52] U.S. Cl. ..... 5/451; 5/474; 156/214

[58] Field of Search ..... 5/451, 452, 449, 422, 5/450, 441, 474; 156/214

[56] References Cited

U.S. PATENT DOCUMENTS 4,773,108 9/1988 Leever ..... 5/508
4,930,172 6/1990 Johenning ..... 5/451

OTHER PUBLICATIONS

"Naturalizer" A Trade Brochure of the Land and Sky Co. of Lincoln Nebr., (c) 1989).

*Primary Examiner*—Alexander Grosz
*Attorney, Agent, or Firm*—Polster, Lieder, Woodruff & Lucchesi

[57] ABSTRACT

A waterbed mattress corners are reinforced by a multi-layered angle made of a plastic material which is permanently fixed to the mattress. the angle has a first leg and a second leg extending from the bottom of the mattress to the top thereof. The first and second legs are disposed generally at ninety degrees with respect to each other. The angle is constructed by securing together a plurality of similarly shaped layers of a plastic material to form the angle. To reinforce a corner of the waterbed mattress the angle is placed over the corner so that one leg of the angle extends along one side of the corner and the other leg extends along the other side of the corner. One leg of the angle is secured to its corresponding side of the corner and the other leg is secured to the other side of the corner.

9 Claims, 2 Drawing Sheets

WATERBED MATTRESS CORNER AND METHOD OF MAKING SAME

BACKGROUND OF THE INVENTION

This invention relates to waterbed mattresses and more particularly to such mattresses with improved corners.

Waterbed mattresses contain a large quantity of water which transmits substantial pressure throughout the interior of the mattress when a weight, such as the human body, is on the mattress. Even the weight of the water itself creates substantial pressure in the mattress.

These mattresses typically are made of a single layer of a plastic material such as vinyl. The thickness and other characteristics of the vinyl are selected to provide adequate strength to resist rupture of the mattress while at the same time providing a resilient feel to the mattress Since a waterbed mattress cannot be formed as a single, unitary piece, it is necessary to seal various portions of the vinyl together by heat welding or the like to form the completed mattress. These seams, particularly in the corners of the mattresses, often are the weakest part of the mattress and the place where the pressure can cause the mattress to rupture. Of course, the rupture may be small, which results in a relatively minor leakage of water from the mattress. Any such leakage is, however, unacceptable.

Waterbed mattresses are also inherently flexible They change their shape when pressures are applied thereto. Thus, for example, when someone tries to place sheets on a waterbed mattress, the mattress will not lift evenly, making it difficult to do so. Sheets for waterbed mattresses typically include a pocket at each corner in which the mattress is inserted to hold the sheets in place. The flexible nature of the waterbed mattress makes it difficult to capture the mattress in these sheet pockets. It also sometimes results in the mattress corner pulling out of the sheet pocket.

SUMMARY OF THE INVENTION

Among the various objects and features of the present invention will be noted the provision of a reinforced corner for a waterbed.

Another object is the provision of a reinforced corner for a waterbed mattress which is both secure and durable.

An additional object is the provision of such a corner with superior leak resistance.

A fourth object is the provision of such a corner which is relatively simple in construction.

A fifth object is the provision of a method of quickly and efficiently making the reinforced corner of the present invention.

A sixth object is the provision of such a reinforced corner which maintains its shape when pressures are applied thereto.

A seventh object is the provision of such a reinforced corner which provides increased corner stability so that sheets tend to stay in place on the waterbed mattress.

Other objects and features will be in part apparent and in part pointed out hereinafter.

Briefly, the waterbed mattress with reinforced corners of the present invention has four corners and structure for reinforcing the corners. The corner reinforcing structure includes a multi-layered angle made of a plastic material which is permanently fixed to the mattress. The layers are permanently fixed to each other. The angle has a first leg and a second leg extending from the bottom of the mattress to the top. The first and second legs are generally disposed at ninety degrees with respect to each other.

The method of the present invention includes the steps of securing together a plurality of similarly shaped layers of a plastic material to form an angle having a pair of legs and placing the angle over the corner so that one leg of the angle extends along one side of the corner and the other leg extends along the other side of the corner. Each leg is secured to its corresponding side of the corner.

BRIEF DESCRIPTION OF THE FIGURES

Similar reference characters indicate similar parts throughout the several views of the drawings.

DESCRIPTION OF THE PREFERRED EMBODIMENT

A waterbed mattress 1 is constructed from a single sheet of a suitable plastic material such as vinyl. This requires that there be at least some seams, such as corner seam 11 and side seam 13, where the flaps of the vinyl meet. These flaps are sealed together by a suitable process such as heat welding, but (as pointed out above) the seams do provide a point of possible leakage when the waterbed mattress is inflated with water.

Figure 1:
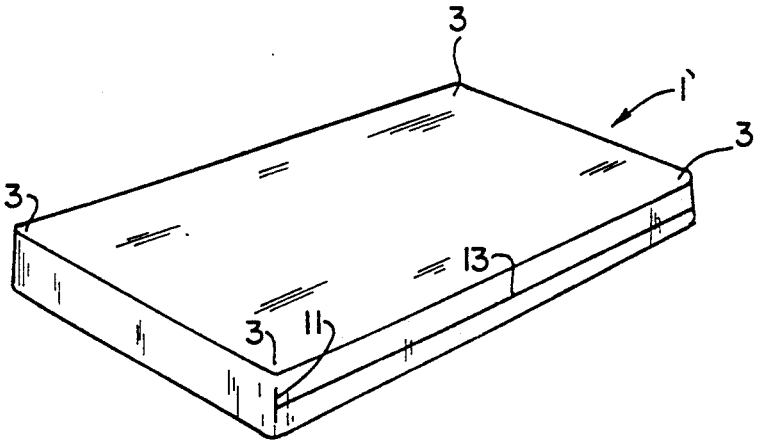
FIG. 1. PRIOR ART
FIG. 1 is a perspective view of a prior art waterbed mattress illustrating the seams in the mattress.
Figure 2:
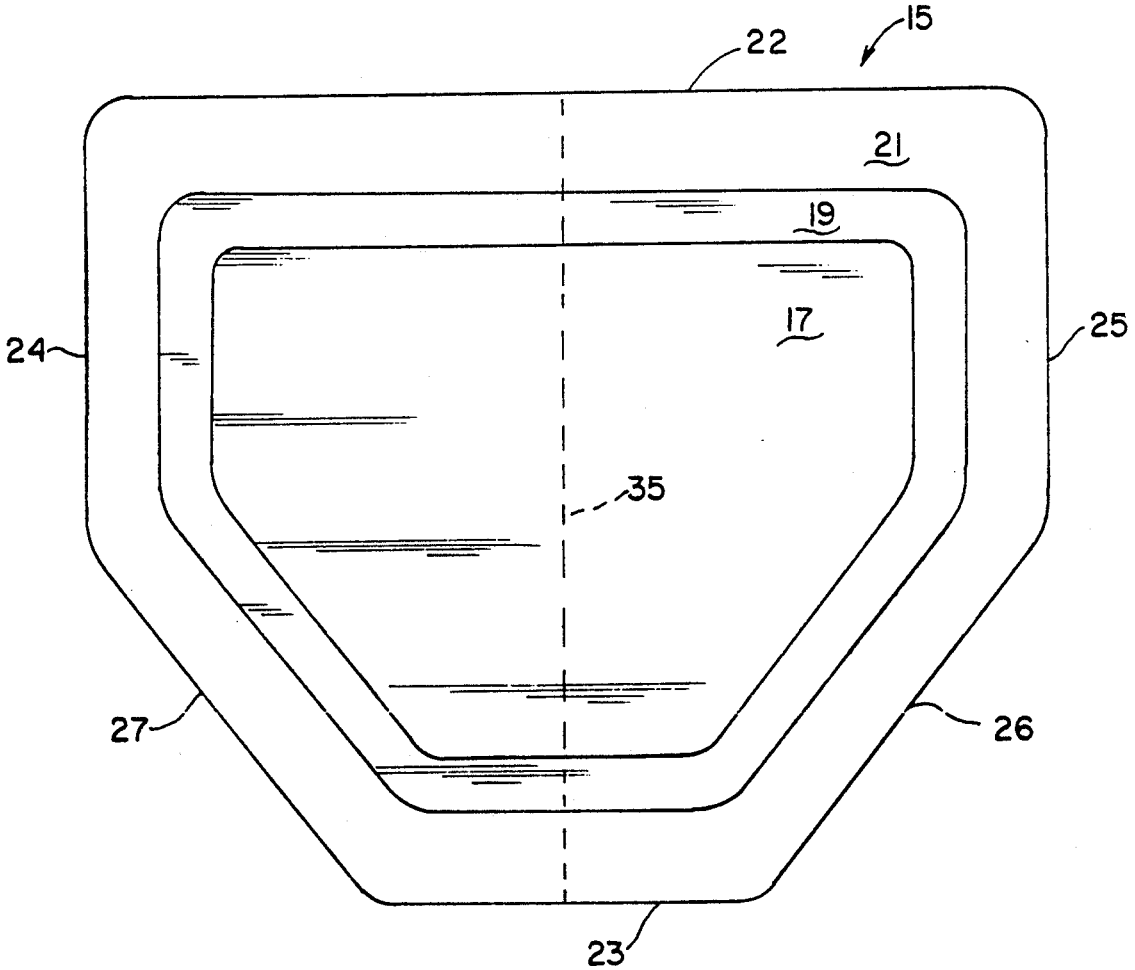
FIG. 2 is an elevation of a corner reinforcing blank of the present invention before it is attached to the mattress.
Figure 1A:
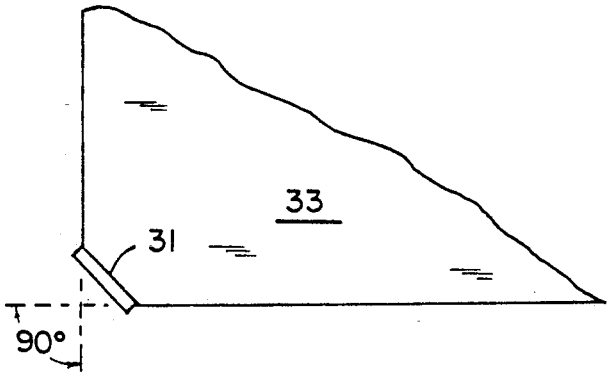
PRIOR ART FIG. 1A.
FIG. 1A is a top plan of a prior art waterbed mattress with a reinforced corner.

A reinforced corner blank 15 (FIG. 2) is designed to significantly reduce the possibility of such leakage. Corner blank 15 also provides increased rigidity to the corner of the mattress so that, for example, it is less difficult to put sheets on the waterbed mattress.

Reinforcing corner blank 15 is preferably made of vinyl like mattress 1 and is readily heat weldable thereto. Because it is less likely to contact a person sleeping on mattress 1, the corner blank 15 may be of heavier vinyl than that making up the rest of mattress 1.

Reinforcing corner blank 15 is made from a plurality of layers of vinyl 17, 19, and 21 which are secured together as by heat welding. Each layer of corner blank 15 is preferably smaller than the layer to which it is welded. They are all of generally the same shape and centered with respect to each other before being welded together.

With reference to layer 21, the corner blank is preferably a hexagon having a top 22, a parallel but smaller bottom 23, two side edges 24, 25 perpendicular to top 22, and two diagonal edges 26, 27 extending between edges 24, 25 and bottom 23. Layer 21 is preferably 12" long at it top, 5" long at its bottom and 9" tall Edges 24 and 25 are preferably 4.75" long. Layer 19 is spaced inward from layer 21 by 1" around all its edges and there is a ⅝" margin between layers 17 and 19.

There have been previous reinforced corners for waterbeds, but these tend to be two-dimensional in character. For example, in FIG. IA there is shown a typical prior art reinforcement 31 for the corner of a waterbed mattress 33. Reinforcement 31 is secured to the corner of mattress 33 by flattening the corner underneath the reinforcement and then welding them together. This results in flattening of the corner into a two-dimensional shape having height and width, but no depth.

Figure 3:
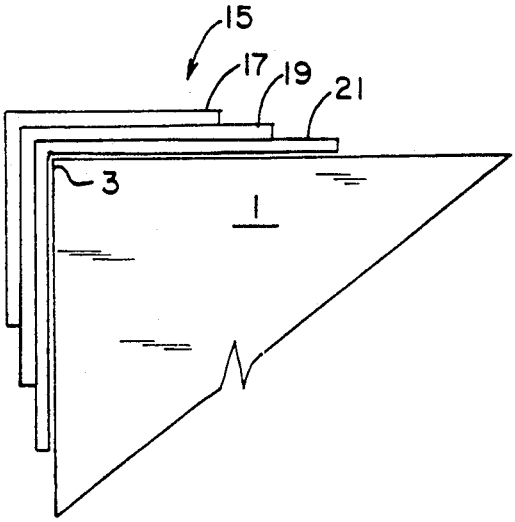
FIG. 3 is a top plan view of the blank of FIG. 2, on an exaggerated scale, secured to a mattress.
Figure 4:
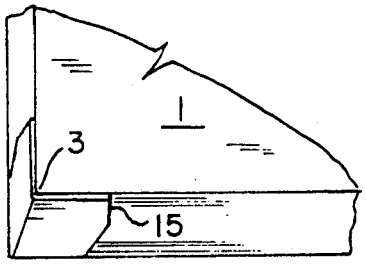
FIG. 4 is a perspective view of the corner blank of FIG. 2 secured to a mattress.

In contrast reinforcing corner blank 15 when secured to the mattress makes a true three-dimensional corner. In attaching blank 15 to mattress 1, blank 15 is bent along its longitudinal axis 35 (FIG. 2) into the angled configuration of FIG. 3. Blank 15 is fixed to corner 3 of mattress 1 as by heat welding around the periphery of layer 13. Unlike the prior art, however, corner 3 is not flattened before reinforcing blank 15 is secured thereto. Instead, blank 15 is bent along line 35 into the shape of corner 3 so that it has two legs at ninety degrees with respect to each other as shown in FIG. 3. Each leg is fixed, by welding or the like, to its corresponding side of the mattress corner to provide a true three-dimensional, reinforced corner, as shown in FIG. 4.

This three-dimensional structure adds extra rigidity to the corners of the waterbed mattress for ease of handling while at the same time reinforcing the seams.

Figure 5:
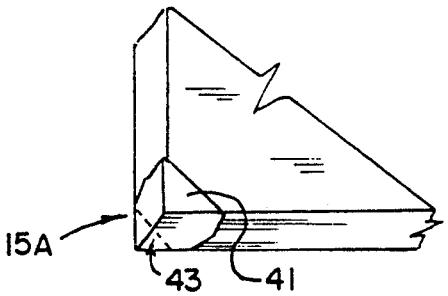
FIG. 5 is a perspective view of a second embodiment of the reinforced corner of the present invention.

A second embodiment of the reinforced corner is shown in FIG. 5. The corner reinforcement 15A of FIG. 5 is the same as reinforcing blank 15 in all respects except that it further includes a top 41 and a bottom 43 so that the corner reinforcement encompasses the mattress corner. The top and bottom 41, 43 may be welded to the mattress as well if desired.

I claim:

1. In a waterbed mattress having corners, means for reinforcing the corners comprising a multi-layered corner reinforcement angle permanently attached to the mattress at a corner thereof, each said layer of each angle being hexagonally shaped with a first layer placeable adjacent the mattress and succeeding layers being placeable on the first layer, said succeeding layers each being progressively smaller in size and centered on the layer over which it is placed.

2. The waterbed mattress of claim 1 wherein each hexagonally shaped layer has a first pair of parallel sides, and a second pair of parallel sides, each side of said second pair having one end intersecting a respective opposite end of one side of said first pair.

3. The waterbed mattress of claim 2 wherein the sides of said first pair are of unequal length.

4. The waterbed mattress of claim 3 wherein the sides of said second pair are of equal length and the side of said first pair with which said sides of said second pair intersect is the longer side of said first pair.

5. The waterbed mattress of claim 4 further including a third pair of sides, each side of said third pair having one end intersecting with the opposite end of one of the respective sides of said second pair of sides, and the other end of said sides of said third pair intersecting a respective end of said shorter side of said first pair of sides.

6. The waterbed mattress of claim 5 wherein the respective angles of intersection between each side of said third pair of sides and said shorter side of said first pair of sides are equal.

7. The waterbed mattress of claim 1 comprising three layers each of which is permanently attachable to the layer on which it is placed.

8. The waterbed mattress of claim 1 wherein the layers forming the angle are foldable about a mid-point of the longer side of said first pair of sides.

9. The waterbed mattress of claim 8 wherein the layers are of a vinyl material.

* * * * *